US010897971B2

(12) United States Patent
Taha

(10) Patent No.: US 10,897,971 B2
(45) Date of Patent: Jan. 26, 2021

(54) WOMEN'S BULLETPROOF BALLISTIC SHIELD HANDBAG

(71) Applicant: Said M Taha, Hackettstown, NJ (US)

(72) Inventor: Said M Taha, Hackettstown, NJ (US)

( * ) Notice: Subject to any disclaimer, the term of this patent is extended or adjusted under 35 U.S.C. 154(b) by 0 days.

(21) Appl. No.: 16/371,091

(22) Filed: Mar. 31, 2019

(65) Prior Publication Data

US 2020/0305566 A1 Oct. 1, 2020

(51) Int. Cl.

| | |
|---|---|
| ***A45C 9/00*** | (2006.01) |
| ***F41H 1/02*** | (2006.01) |
| ***F41H 5/08*** | (2006.01) |

(52) U.S. Cl.

CPC ..... *A45C 9/00* (2013.01); *F41H 1/02* (2013.01); *F41H 5/08* (2013.01)

(58) Field of Classification Search

CPC ..... A45C 9/00; F41H 1/02; F41H 5/08
USPC ..... 150/106
See application file for complete search history.

(56) References Cited

U.S. PATENT DOCUMENTS

| | | | | |
|---|---|---|---|---|
| 6,419,132 | B1 * | 7/2002 | Reed | A45C 15/00 109/49.5 |
| 6,685,071 | B2 * | 2/2004 | Prather | A45C 15/00 2/2.5 |
| 10,098,441 | B1 * | 10/2018 | Holloman | A45C 9/00 |
| 10,130,160 | B1 * | 11/2018 | Cheng | A45F 3/06 |
| 2019/0174903 | A1 * | 6/2019 | Holder | A45F 4/02 |
| 2020/0025523 | A1 * | 1/2020 | Ross | A45F 3/06 |
| 2020/0132417 | A1 * | 4/2020 | Xiang | B42F 7/06 |

* cited by examiner

*Primary Examiner* — Joshua T Kennedy

(57) ABSTRACT

Disclosed is a handbag (e.g., purse) that easily converts from a handbag into a bulletproof vest for a user. While the handbag provides the aesthetic appearance of a typical bag which a lady may carry, the handbag is configured with features that enable a user to remove a bullet proof vest from within a specifically configured compartment within the handbag, and then wear the handbag around the user's abdomen so that the bulletproof vest can protect the user's chest. Furthermore, a bulletproof vest may be attached to the handbag, such that while the removed bullet proof vest can protect the user's chest, the remainder of the handbag can protect the user's back.

5 Claims, 4 Drawing Sheets

WOMEN'S BULLETPROOF BALLISTIC SHIELD HANDBAG

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of personal safety devices, firearm armor and protection from firearms shots. More particularly, the present invention is in the field of using bullet proof vest to protect body from gun shots.

Conventional bullet proof vests are heavy and bulky and designed more for law enforcement and military personnel for field operations.

SUMMARY OF THE INVENTION

The present invention is a hand-carry bag, a purse, that can be converted fast and easy into a bullet-proof vest. Present invention is an every-day item, that looks and can be used like many other similar bags and purses, except that it can quickly be turned into a bullet proof vest that protects vital organs in human body from gun shots from the front and from the back. Present invention can also be used as a hand-held shield when time does not allow to convert it to a vest.

DETAILED DESCRIPTION OF THE INVENTION

Figure 1:
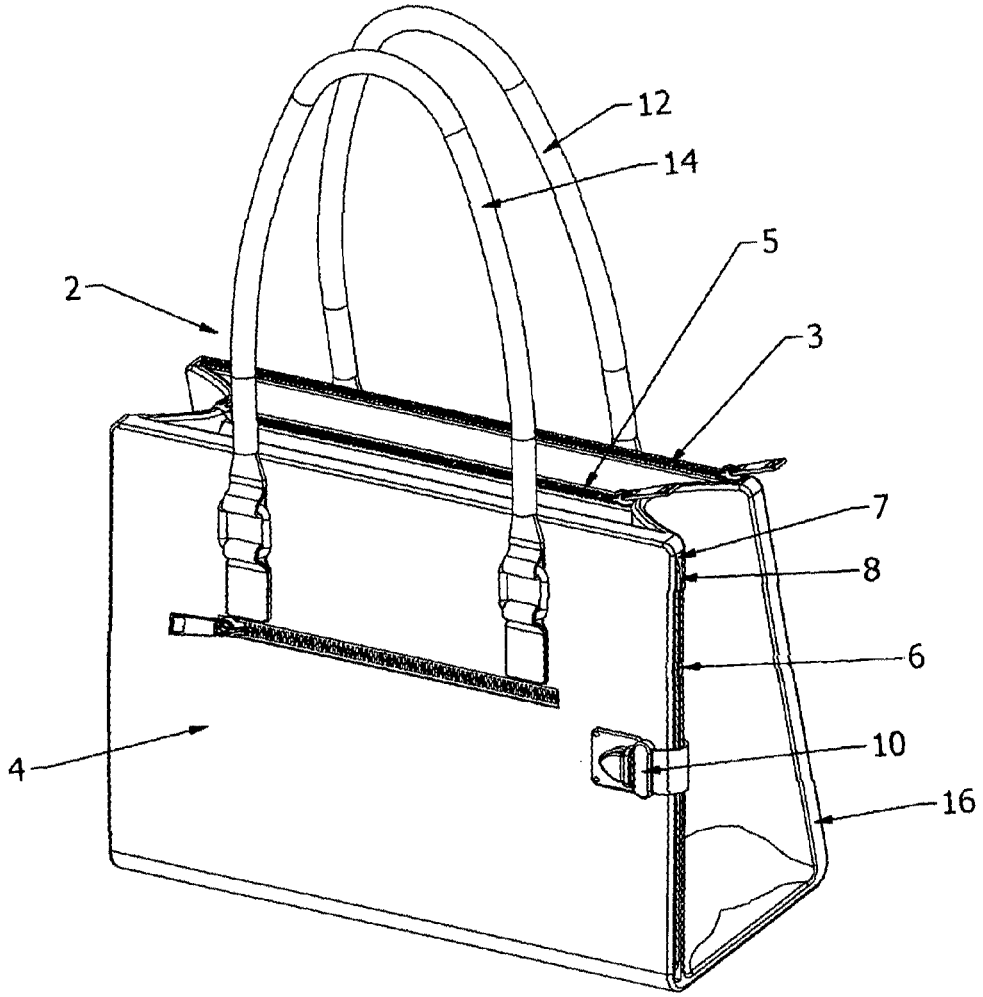
FIGS. 1 and 2 are isometric views of safety purse of the present invention.
Figure 2:
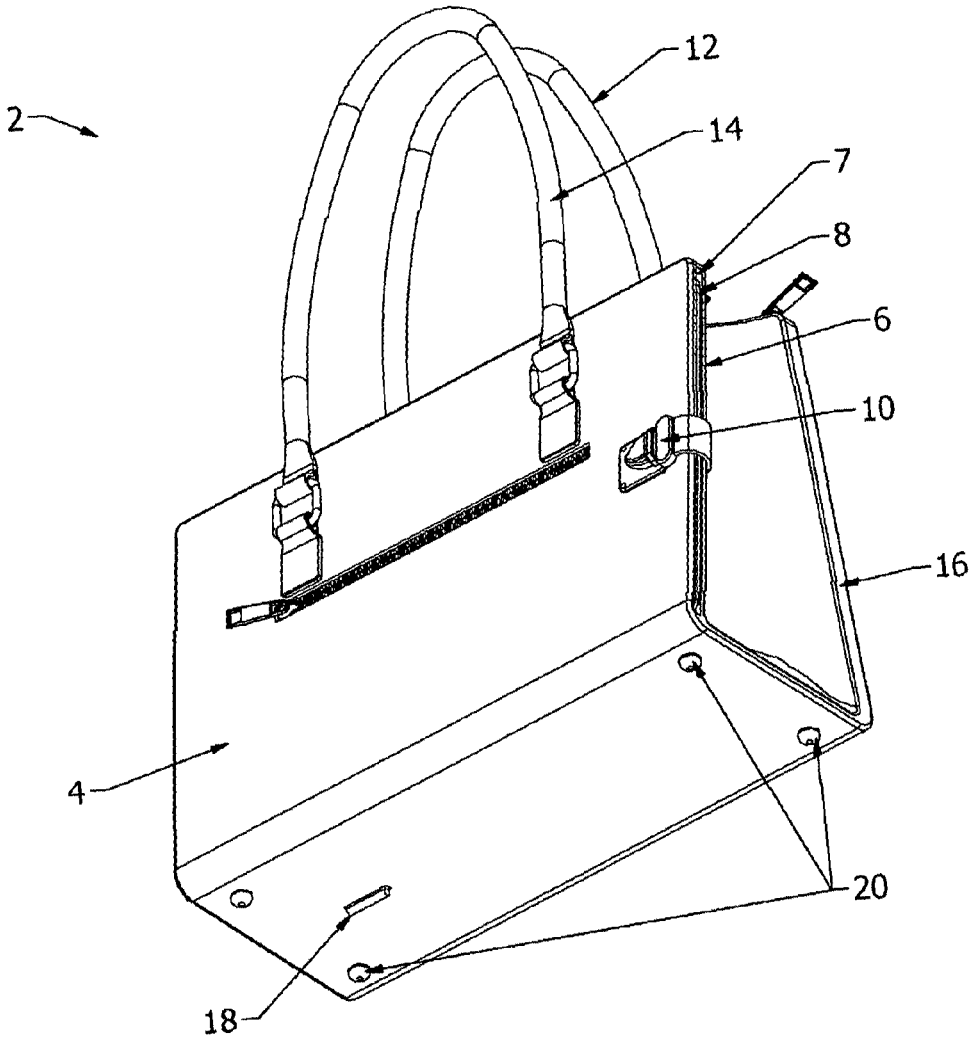

Referring now to FIGS. 1 and 2 in details there is shown a hand-carry purse 2 with actual purse body 4, carrying handles 12 and 14, zipper 5 closing central compartment of purse 4 and zipper 3 closing side compartment 16 of purse body 4. Said side compartment 16 has additional space in it for holding Kevlar® plate that always stays inside that compartment 16 and is hidden from view. Purse has opposite side 6 with side opening 7 that holds a removable Kevlar® front shield 8. Said side opening 7 under normal every day use is latched closed with sliding latch 10. In FIG. 1B also shown bottom of purse 2 with legs 20 and end of retractable waist strap 18.

Figure 3:
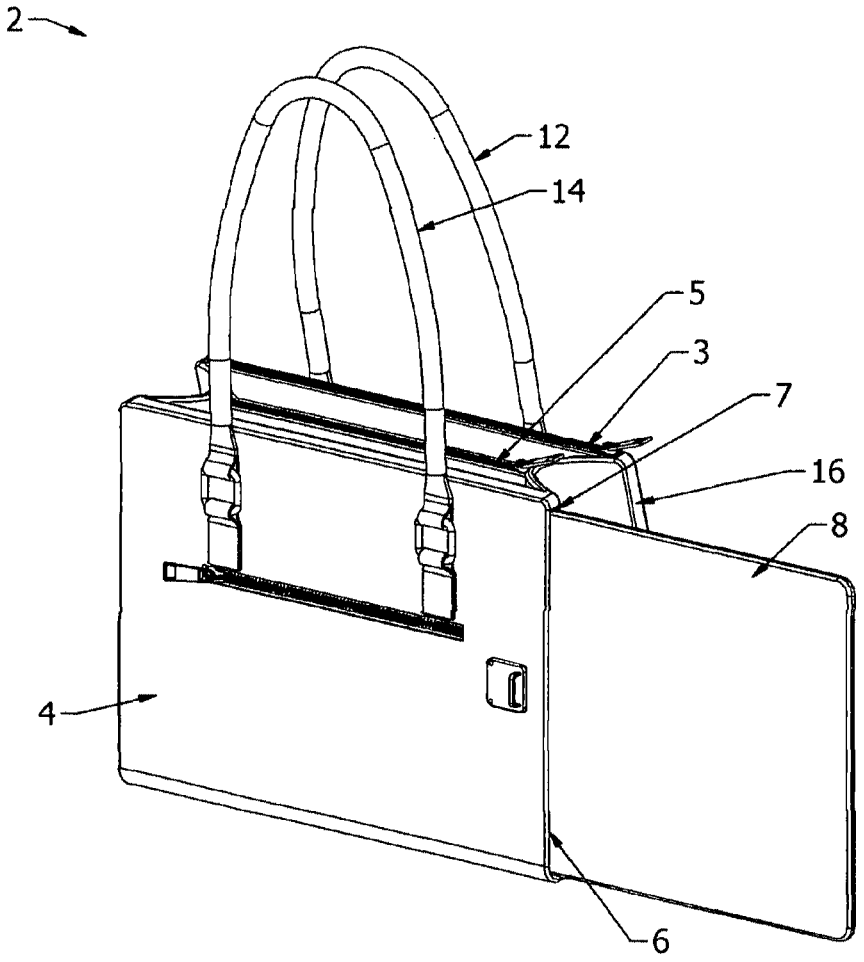
FIG. 3 is an isometric view of the safety purse of present invention with front shield partially pulled out.

Referring now to the invention in more detail, in FIG. 3 there is shown the purse 2 with Kevlar® front shield 8 partially pulled out of side compartment 7.

Figure 4:
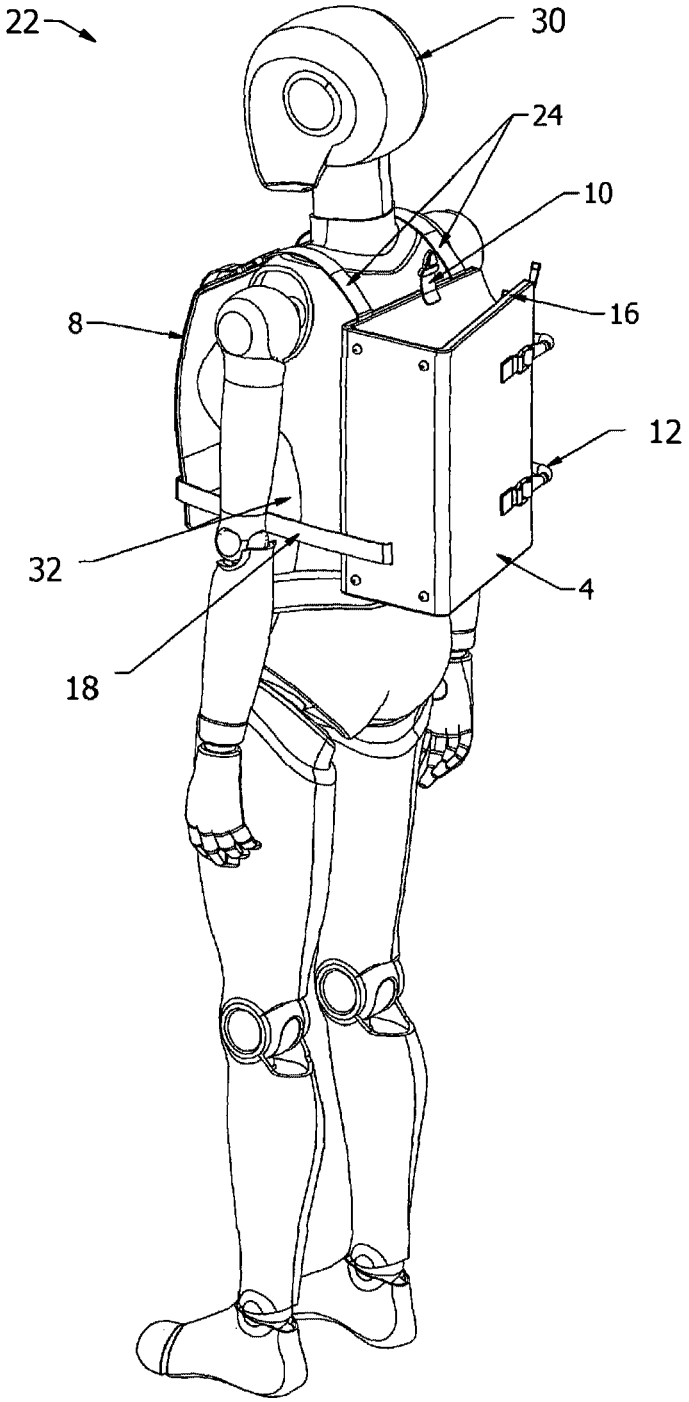
FIG. 4 is an isometric view of a person wearing the fully strapped safety purse of the present invention.

Now referring to FIG. 4 in more details shown is a human body FIG. 30 with safety purse 2 in position to be put on and fully strapped. Shown is safety purse 4 positioned at the back of human FIG. 30 with front Kevlar® plate 8 fully retracted from the purse 4. Said front Kevlar plate 8 is attached to purse 4 with front straps 26 and rear straps 24 with adjustment buckles 28 between the front straps 26 and rear straps 24. In FIG. 3B shown also is partially retracted waist strap 18 from the bottom of purse 4.

FIG. 4 shows the purse 4 fully converted into body armor and strapped securely to human body FIG. 30. There is shown a front Kevlar® plate 8 positioned at the front of FIG. 30 to protect chest area 34 and vital upper body organs from gun shots. Front Kevlar® plate 8 is secured to the body 30 with rear shoulder straps 24, adjustment buckles 28 and front shoulder straps 26, which have free adjustment ends 36. Pulling said adjustment ends 36 will allow to adjust vertical position of front Kevlar® plate 8.

Said front Kevlar® plate 8 is also strapped to the body 30 with fully retracted waist strap 18, which passes around figure's waist line 32, around front of Kevlar® plate 8, loops through either one or both handles 12 and 14 of purse 4 and returns to be secured to itself with Velcro®.

The advantages of the present invention include, without limitation, that it provides without limitation all functionalities of a conventional bag or purse and provides fast and easy way to be converted into a bullet proof vest.

In broad embodiment, the present invention is an ordinary-looking hand carry purse or bag, it cannot be distinguished from other similar items visually. Yet, current invention provides unique features allowing to convert it into a body armor, bullet proof vest that may save life. While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as described and claimed.

The invention claimed is:

1. A handbag configured with bulletproof capabilities, comprising:

a first side of the handbag having a first handle;

a second side of the handbag having a second handle;

a closable main opening accessible on a top side of the handbag and positioned somewhere between the first and second sides of the handbag, in which the main opening leads to a primary compartment inside which a user places personal belongings;

a side opening positioned generally perpendicular to the main opening on the first side of the handbag and which leads to a secondary compartment that is distinct from the primary compartment and in which a bulletproof vest is removably stored;

an openable latch that secures the side opening in a closed position when not opened; and a pair of straps attached to the bulletproof vest, the straps being secured to an interior of the secondary compartment, and wherein the straps has have a length that extends out from the secondary compartment when the bulletproof vest is removed from the secondary compartment and are configured as shoulder straps to position a user's head between the straps and the bulletproof vest to protect a user's chest are such that the handbag operates as a garment that enables the user to wear, and thereby convert, the handbag into a bullet proof vest.

2. The handbag of claim 1, further comprising a handle attached to the bulletproof vest to facilitate pull out of the bulletproof vest from the side opening.

3. The handbag of claim 2, further comprising a second bulletproof vest positioned inside a tertiary compartment of the second side of the handbag, such that the bulletproof vest and the second bulletproof vest configured to protect different parts of a user's body.

4. The handbag of claim 3, wherein the tertiary compartment of the handbag is sealed such that the second bulletproof vest is permanently attached inside the tertiary compartment of the handbag.

5. The handbag of claim 4, further comprising an extendable strap that extends from a bottom side of the handbag when the bulletproof vest is removed from the handbag and the handbag is worn by the user, in which the extendable strap is configured to pull around a user's abdomen to provide additional support when the handbag is worn.

* * * * *